United States Patent [19]

Bauman

[11] 4,246,001

[45] Jan. 20, 1981

[54] MOLTEN SALT PYROLYSIS OF LATEX

[75] Inventor: Albert J. Bauman, Sierra Madre, Calif.

[73] Assignee: The United States of America as represented by the Administrator of the National Aeronautics and Space Administration, Washington, D.C.

[21] Appl. No.: 900,659

[22] Filed: Apr. 27, 1978

[51] Int. Cl.[2] ..... C10L 1/16; C10B 53/08; C10B 17/00; C10B 51/00

[52] U.S. Cl. ..... 44/62; 44/50; 201/8; 201/10; 201/25

[58] Field of Search ..... 201/7, 10, 25, 27, 2.5, 201/8; 260/680 R, 106; 44/55, 62, 50

[56] References Cited

U.S. PATENT DOCUMENTS

| | | | |
|---|---|---|---|
| 1,030,011 | 6/1912 | Pope | 201/10 |
| 3,186,923 | 6/1965 | Lyness | 201/25 |
| 3,708,270 | 1/1973 | Birk | 201/10 |

FOREIGN PATENT DOCUMENTS

| | | | |
|---|---|---|---|
| 51-100103 | 9/1976 | Japan | 201/25 |
| 52-10450 | 1/1977 | Japan | 201/10 |
| 580579 | 9/1946 | United Kingdom | 201/18 |

OTHER PUBLICATIONS

Chem. Abstracts, vol. 46, p. 1723d.

Chem. Abstracts, vol. 39, p. 1019 (2).

*Primary Examiner*—Joseph Scovronek

*Assistant Examiner*—Chris Konkol

*Attorney, Agent, or Firm*—Monte F. Mott; John R. Manning

[57] ABSTRACT

Latex-rich plants such as Guayule or extracts thereof pyrolyzed in an inert nitrogen atmosphere in inorganic salt melts such as a LiCl/KCl eutectic at a temperature of about 500° C. yield over 60% of a highly aromatic, combustible hydrocarbon oil suitable for use as a synthetic liquid fuel.

12 Claims, 1 Drawing Figure

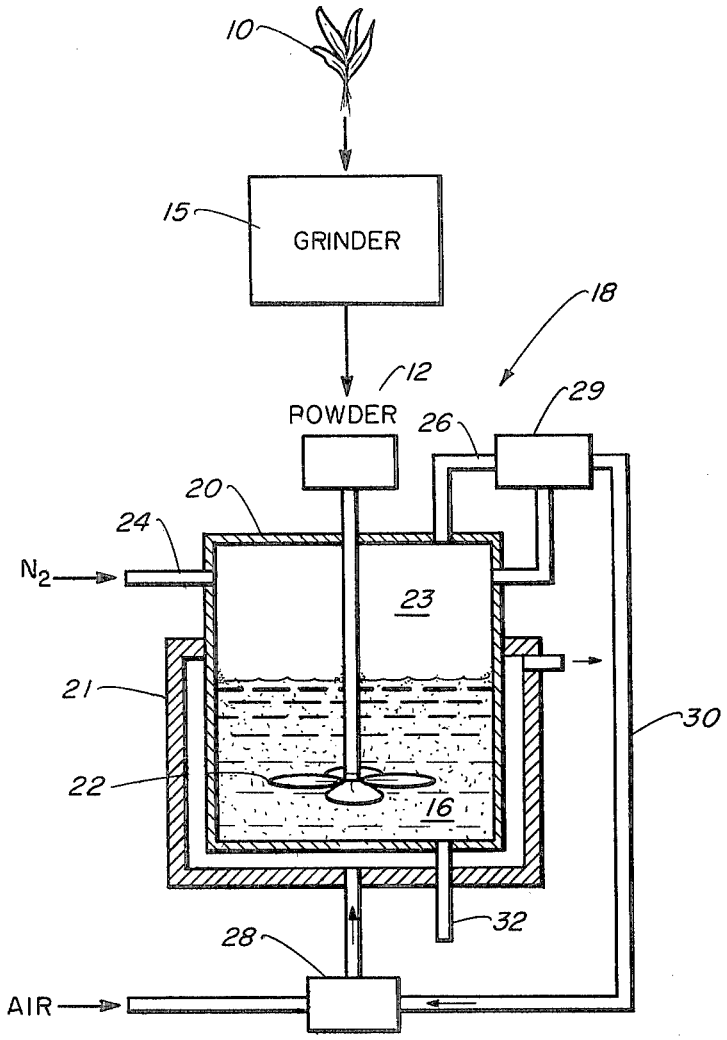
Figure

MOLTEN SALT PYROLYSIS OF LATEX

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

BACKGROUND OF THE INVENTION

1. Field of the Invention

The present invention relates to production of synthetic hydrocarbon liquid fuel and, more particularly, to the production of such fuels by pyrolysis of latex-rich plants.

2. Description of the Prior Art

Over the last 100 years, we have converted from wood, a renewable source of energy to coal and then to oil and gas, non-renewable sources of energy. Recently, oil and gas have periodically been in short supply and the cost has been steadily increasing. Both petroleum and natural gas have begun to decrease as a fraction of total use with nuclear power rising slowly and hydropower and geothermal power rising even more slowly. The cost of finding new fossil fuel is increasing, while the number of discoveries are declining. Energy costs will irrevocably rise with the gradual depletion of these stored products of ancient photosynthesis. The only direction that fossil fuel prices can go is up. In the United States nearly all the hydropower available is already in use and geothermal energy while being intensively developed is, mainly available only in the western United States and will only supply a small percentage of local needs. Nuclear energy could supply up to 20% of energy needs but development is being hampered by environmental and political concerns.

The principal, available renewable source of energy is the sun. The amount of solar energy falling on the earth's surface in just 10 days is equivalent to all known fossil fuel reserves on earth. Millions of years ago, just as they do now, green plants converted about 1% of the sunshine that fell on them into carbohydrates. Perhaps 1% of the plant materials grown back then were converted into coal, oil, or natural gas, a net yield of something like 0.01%. The same sun still shines. And although there are a lot more people now and they use—particularly in the United States—a lot more energy than they used to, the present average energy demand per person can be met with 10% recovery of the sun falling on an area 3 yards square between latitudes 40° N. and 40° S. This is where 80% of the world's population lives and where the greatest needs are found.

There are several different ways of utilizing solar radiation. The radiation can be collected as heat and utilized in heat engines, air conditioning, wind mills, wave engines, etc. New heat collection systems which utilize absorbers or concentrators such as mirrors, lenses or reflectors are useful but not very efficient.

Photosynthesis directly converts visible light into chemical bonds with useful energy from 50-90 kcal/mol. The principal product of most green plants is carbohydrate. For many years research has been carried out seeking to produce combustible synthetic liquid fuels from forest products and field plants. Though good yields of complex, corrosive "pyrolysis oils" suitable for fuels have been obtained, these efforts have not been successful in terms of producing transportable, storable high-BTU liquid fuels.

SUMMARY OF THE INVENTION

High yields of aromatic hydrocarbon liquid fuels have been achieved in accordance with the invention by pyrolysis of high isoprene latex plants or extracts thereof in a molten inorganic salt at temperatures above 300° C., generally from 400° C. to 700° C. At lower temperatures yields are too low and at higher temperatures, excessive gasification occurs. Production of liquid organic solvents and solvent fractions can be achieved by regulation of process parameters.

The process of the invention utilizes plants which produce high molecular weight, polyisoprenic hydrocarbon. During pyrolysis the polyisoprene units are depolymerized and rearrange into aromatic compounds which are liquids at room temperature. There are about 2000 plant species that produce hydrocarbon. Hevea is the principal species produced in the world. A few Euphorbia species can be commercially grown in the United States such as *E. lathyrus* containing about 5-8% latex, *E. tirucalli,* approximately one third hydrocarbon, Russian dandelion (*Taraxacum kox saghz* Rodin) and Guayule (*Parthenium argentatum* Gray).

The Guayule plant is a desert shrub native to the southwestern United States and northern Mexico that produces a polymeric isoprene latex essentially identical to that from Hevea rubber trees in Malaysia. At one time, prior to 1910, it was the source of about half the natural rubber used in the United States. Since 1946, however, its use as a source of rubber has been abandoned in favor of lower cost Hevea rubber and synthetic rubber. Recently a program of research was directed to the production of combustible hydrocarbons in plants such as the Guayule. Tapping of latex at regular intervals is not feasible, because in Guayule the latex is present as tiny inclusions in the bark, which are not interconnected. Typically the plant is allowed to reach maturity during the second year of growth, and is then harvested, cutting down the entire plant. For rubber extraction it is necessary to first coagulate the latex in the cells, remove dirt from the roots, and strip the leaves from the stems. Rubber is then released by a caustic milling step, which gives a floating latex. The present pyrolysis process is carried out in a much more simple manner, using newly harvested plants.

Bioinduction agents capable of increasing the growth rates and the latex production of guayule plants by 100 to 400% are described in my earlier patent application, Ser. No. 819,263, filed July 27, 1977, entitled "Enhancement of Polyisoprene Latex Production". In view of the inherent high isoprene-type hydrocarbon content of such plants the direct pyrolysis or thermal decomposition process in molten salt medium of this invention shows promise as a method for recovering useful aromatic-rich liquid fuels and specific organic chemicals from ground Guayule plants, not separately extracted or otherwise processed. With the lithium chloride + potassium chloride molten salt eutectic excellent yields were obtained, and the molten salt is fully recoverable, or useful for continuous processing.

The process of the invention is practiced at moderate temperature which decreases the cost of energy and the cost of the reactors and does not require hydrogen as is required in liquefaction or gasification of coal. The process utilizes ordinary, readily available molten salts which are not highly corrosive at the temperatures of the process.

These and many other attendant advantages of the invention will become readily apparent as the invention becomes better understood by reference to the following detailed description when considered in conjunction with the accompanying drawings.

BRIEF DESCRIPTION OF THE DRAWINGS

The FIGURE is a schematic view of the processing of hydrocarbon containing plants into liquid fuel according to the present invention.

DESCRIPTION OF THE PREFERRED EMBODIMENTS

Referring now to the FIGURE, the newly harvested plant 10 is ground to a powder 12 in a suitable grinding apparatus 15 such as a ball mill, roller mill etc. The powder 12 is then fed to a bed of molten inorganic salt 16 contained within pyrolysis unit 18. The pyrolysis unit contains a reactor 20, a heating means such as a combustion gas jacket 21 and a stirrer 22. The unit may be provided with a condenser 29. Pyrolysis is conducted in the absence of oxygen. Therefore an inert gas such as nitrogen is fed into the headspace 23 through inlet 24. The nitrogen gas can be utilized to sweep the gases developed during pyrolysis through gas outlet 26. The gases can be utilized to support the pyrolysis temperature by delivery to combustion unit 28 through line 30 or can be recovered for future use or further treatment. A liquid oil product is recovered through outlet 32 at the end of the run. The water content of the plant should be low since water would be converted to steam in the reactor and could gasify some of the hydrocarbon by oxidation. The plant or powder can be dried at a moderate temperature from 30° C.–70° C., if necessary, before being fed to the pyrolysis unit.

The molten salt functions as a massive, thermal sink. The molten salts are excellent heat transfer media and promote much faster thermal cracking reaction rates. They provide excellent contact between the powder and the melt. The molten salt is preferably inert, not being degraded by nor consumed by the pyrolysis reaction. The molten media can be any of the salts utilized for hydrocracking of petroleum or coal such as carbonates, phosphates, silicates or halides of Group I or Group II metals. Suitable materials are zinc chloride or lithium chloride-potassium chloride eutectics containing 54% by weight of KCl and 46% by weight of LiCl. The molten salt is present in excess as compared to the plant, the ratio of salt to plant being at least 2/1, generally from 5/1 to 20/1.

Examples of practice follow:

EXAMPLE 1

Newly harvested 8 month old Guayule plants with rubber contents of 2–3% (dry weight basis) were dried at about 60° C., ground to a powder under liquid nitrogen in a mortar-and-pestle vessel, and transferred to a few grams at a time into a molten salt stirred pyrolysis vessel which could be of any suitable design, but was similar to the Larsen and Chang apparatus for pyrolysis under nitrogen, as described in *Rubber Chem. Tech.* 49, 1120–28 (1976). Guayule plants of the W.W. II Emergency Rubber Program strain 593 were used.

Typically the vessel was a four-necked round bottomed flask, with a high speed tantalum stirrer, a thermocouple well, a solid addition well, and a Claisen-type distillation head. About 100 to 200-gram quantities of molten salt were present, such as the eutectic of lithium chloride and potassium chloride having about 46 wt. % LiCl and 54 wt. % KCl. Upon reaching a temperature of about 500° C. the first powdered Guayule was added, under nitrogen, and some volatiles were immediately noted. After all of the volatiles were allowed to distill off and were collected and dried over a drying agent such as sodium sulfate, about 62 wt. % of a yellow oil was obtained. This is the yield based on the dry weight of powdered Guayule. Upon redistillation under nitrogen the main fraction was found to boil at about 140° to 160° C. and to have about 13,200 BTU/lb. heat of combustion. A gaseous fraction was separately collected but its heating value was not determined.

Work is still in progress to more completely identify the product components. A gas chromatographic-mass spectrometer study with a micro Styrogel-100 column or other molecular sieve type material gave four fractions of molecular weight of about 1000 to 5000 or as high as 10,000 in certain cases. Each of the four fractions appears to be of the same general class, highly aromatic as indicated by flame tests showing a smoky flame and by resemblance of certain fractions to isopropyl benzene, or other substituted aromatic hydrocarbons. Some of the liquid fractions also may contain substituted furfurals. Analysis of the gaseous fractions by high speed liquid chromatography suggests that mainly isoprenes and substituted benzenes are present. Adding $ZnCl_2$, about 1 wt. %, to the eutectic enhances aromatic yields.

EXAMPLE 2

The steps of Example 1 were repeated using Guayule rubber fractions, generally similar to the products described in copending application Ser. No. 819,263, mentioned above. It has been expected that mainly isoprenic or non-aromatic products would result. Under the same temperatures of reaction, 500 ° C., and the same molten salt stirred system, above, yellow oily products were obtained with an aromatic odor, and which burnt with a smoky flame, and which upon analysis as above appeared to be extremely similar or identical liquid fuel products, again with a fuel value of about 13 BTU/lb.

EXAMPLE 3

For comparison a cellulosic plant material, cotton was similarly pyrolyzed. Example 1 was repeated with masses of cotton producing a yellow oil and a considerable amount of water in the volatiles. The yield of oil was 43 wt. % of a fairly viscous material having the odor of caramel. Upon GC-MS anaysis about 18 fractions were noted, all of them totally different from the fractions and peaks of the products from Examples 1 and 2 where Guayule had been used. This serves to further show the special potential of this Guayule to produce the desired liquid combustible fuel. If any characteristic feature of the molten salt used or if the particular pyrolysis system were responsible, rather than Guayule, it is believed that at least one of the 18 fractions would be identical. This "oil" is likely to be a mixture of various molecular fragments of cellulose, as described by F. Shafizadeh (TAPPI Biomass Meeting, June 1977, Madison, Wisconsin), such as levoglucosenone. Its fuel value was about 10,600 BTU/lb. and it was strongly acid. In all cases described the pyrolysis fuels were accompanied by water and insoluble black "chars", which represent the remainder of the materials balance. Such chars have a fuel value of from 13,000–15,000 BTU/lb. Petroleum fuel oils have values of 17,000–20,000 BTU/lb.

It is to be realized that only preferred embodiments of the invention have been described and that numerous substitutions, modifications and alterations are permissible without departing from the spirit and scope of the invention as defined in the following claims.

What is claimed is:

1. A method of preparing a hydrocarbon liquid fuel comprising the steps of:

pyrolyzing a high polyisoprene content latex plant in a molten inorganic salt at a temperature of at least 300° C.; and recovering a hydrocarbon oil pyrolysis product.

2. A method according to claim 1 in which the temperature is from 400° C. to 700° C.

3. A method according to claim 1 in which the plant is Guayule.

4. A method according to claim 3 in which freshly harvested plants are ground to a powder before pyrolysis.

5. A method according to claim 1 in which pyrolysis is conducted in the absence of oxygen.

6. A method according to claim 5 in which the molten salt is selected from carbonates, phosphates, silicates or halides of Group I or Group II metals.

7. A method according to claim 6 in which the molten salt is a mixture of lithium chloride and potassium chloride.

8. A method according to claim 7 in which the molten salt is a eutectic containing 54% by weight of potassium chloride and 46% by weight of lithium chloride.

9. A method according to claim 6 in which the ratio of molten salt to plant by weight is at least 2/1.

10. A method according to claim 9 in which the reaction is conducted in the presence of an inert gas.

11. A method according to claim 10 further including the step of flowing the inert gas over the melt to sweep away the pyrolysis gases.

12. A method according to claim 8 in which the melt further contains from 0.1 to 3% by weight of zinc chloride.

* * * * *